US012064023B2

(12) United States Patent
Poletto

(10) Patent No.: US 12,064,023 B2
(45) Date of Patent: Aug. 20, 2024

(54) APPLICATOR FOR COSMETICS IN TWO COMPONENTS

(71) Applicant: BRIVAPLAST S.r.l., Milan (IT)

(72) Inventor: Anna Poletto, Milan (IT)

(73) Assignee: BRIVAPLAST S.r.l., Milan (IT)

( * ) Notice: Subject to any disclaimer, the term of this patent is extended or adjusted under 35 U.S.C. 154(b) by 0 days.

(21) Appl. No.: 17/650,144

(22) Filed: Feb. 7, 2022

(65) Prior Publication Data

US 2022/0248828 A1 Aug. 11, 2022

(30) Foreign Application Priority Data

Feb. 9, 2021 (IT) ..... 102021000002843

(51) Int. Cl.
*A45D 40/26* (2006.01)
*A46B 3/18* (2006.01)
(Continued)

(52) U.S. Cl.
CPC ..... *A45D 40/267* (2013.01); *A46B 3/18* (2013.01); *A46B 9/021* (2013.01); *A46B 15/0081* (2013.01); *A46B 2200/1046* (2013.01)

(58) Field of Classification Search
CPC .. A45D 40/262; A45D 40/265; A45D 34/042; A45D 34/045; A46B 9/021;
(Continued)

(56) References Cited

U.S. PATENT DOCUMENTS 1,460,850 A * 7/1923 Hokanson ..... A46D 3/00 15/206
1,635,970 A * 7/1927 Cave ..... B25G 3/00 15/206
(Continued)

FOREIGN PATENT DOCUMENTS

EP 1475013 A1 11/2004
WO 2013153525 A1 10/2013

OTHER PUBLICATIONS

Search Report for Italian Application No. 102021000002843 dated Nov. 4, 2021.

*Primary Examiner* — Jacqueline T Johanas
*Assistant Examiner* — Holly T. To
(74) *Attorney, Agent, or Firm* — Pearne & Gordon LLP

(57) ABSTRACT

Applicator for cosmetic products including a wire made of metal material that includes a U-shaped body bearing tufts of bristles inside it, which is subsequently subjected to multiple twists so as to form a single body capable of holding the tufts in a stable position and arranging them into a spiral pattern, wherein an element in plastic material arranged outside the wire of metal material is associated with the brush, and held in stable engagement with it, the element including a centrally pierced flanged base body, with a shaped wall departing vertically from the external edge of the flange, only partially covering the brush, the wall bearing on its external surface at least one series of cosmetic product applicator tips, the hole of the base of the plastic element housing the terminal portion of the brush. In addition, the cylindrical base body has outward-facing toroidal ribs along its external surface designed to engage the brush thus constituted with the stem of the gripping and manoeuvring element of the applicator.

15 Claims, 4 Drawing Sheets

(51) Int. Cl.
*A46B 9/02* (2006.01)
*A46B 15/00* (2006.01)

(58) Field of Classification Search
CPC ..... A46B 2200/106; A46B 2200/1053; A46B 2200/1046; A46B 3/18; A46B 15/0048; A46B 15/0081; A46B 11/0089; A46B 11/0093
USPC ..... 132/218; 15/248.1, 247, 207, 206
See application file for complete search history.

(56) References Cited

U.S. PATENT DOCUMENTS 1,768,301 A * 6/1930 Weber ..... A46B 7/04 132/308
1,822,631 A * 9/1931 Jose ..... A61C 17/26 15/23
2,183,139 A * 12/1939 Hertzberg ..... A46B 7/10 15/176.4
2,515,094 A * 7/1950 Price ..... A45D 24/16 132/153
2,533,106 A * 12/1950 Grover ..... A61C 17/24 15/23
3,237,630 A * 3/1966 Eugene ..... A45D 40/265 401/262
3,551,932 A * 1/1971 Grossman ..... A46B 13/02 15/23
3,908,676 A * 9/1975 Levine ..... A46B 9/021 15/160
4,167,192 A * 9/1979 Arnold ..... A46B 7/00 132/212
4,335,480 A * 6/1982 Liu ..... A61C 17/26 15/23
4,662,385 A * 5/1987 Schefer ..... A45D 34/04 132/218
5,007,442 A * 4/1991 Hirzel ..... A45D 19/026 132/218
5,865,556 A * 2/1999 Lhuisset ..... A46B 11/001 132/218
6,053,179 A * 4/2000 Lhuisset ..... A45D 40/262 132/142
6,131,228 A * 10/2000 Chen ..... A46B 15/0081 15/210.1
6,408,857 B1 * 6/2002 Neuner ..... A46B 3/18 132/218
7,909,043 B2 * 3/2011 Kurek ..... A46B 9/021 132/218
8,079,106 B2 * 12/2011 Yang ..... A61C 17/26 15/23
8,276,596 B2 * 10/2012 Marciniak-Davoult ..... A45D 40/265 132/218
8,998,522 B2 * 4/2015 Gueret ..... A46B 9/021 401/129
9,033,605 B2 * 5/2015 Gueret ..... A46B 9/021 401/129
10,111,516 B1 * 10/2018 Kim ..... A46B 3/20
2002/0023657 A1 * 2/2002 Gueret ..... A45D 40/265 132/218
2008/0271746 A1 * 11/2008 Gueret ..... A45D 40/265 132/218
2009/0065020 A1 * 3/2009 Butcher ..... A46B 9/021 15/160
2009/0276973 A1 * 11/2009 Bouix ..... A46B 9/021 15/207.2
2010/0083979 A1 * 4/2010 Kim ..... A45D 40/264 132/218
2010/0175708 A1 * 7/2010 Kim ..... A46B 9/021 132/218
2010/0294298 A1 * 11/2010 Kim ..... A46B 9/021 132/218
2014/0076350 A1 * 3/2014 Aso ..... A46B 3/005 132/218
2014/0290681 A1 * 10/2014 Pires ..... A45D 34/046 401/121
2015/0320177 A1 * 11/2015 Pires ..... A45D 40/265 401/129
2016/0143419 A1 * 5/2016 Sanchez ..... A45D 40/265 401/129
2016/0331122 A1 * 11/2016 Knight ..... A46B 15/0081
2017/0088315 A1 * 3/2017 Jacob ..... B65D 41/0407
2017/0333062 A1 * 11/2017 Patel ..... A61B 17/244
2017/0347776 A1 * 12/2017 Jacob ..... A46B 3/18
2017/0347784 A1 * 12/2017 Jacob ..... A46B 3/18
2018/0049530 A1 * 2/2018 Chant ..... A45D 2/48
2020/0069032 A1 * 3/2020 Dempsey ..... A45D 40/18
2020/0113308 A1 * 4/2020 Park ..... A45D 40/262
2020/0288855 A1 * 9/2020 Borsari ..... A46B 7/044
2020/0329847 A1 * 10/2020 Bianco ..... A45D 34/043
2020/0383462 A1 * 12/2020 Leonard ..... A46B 9/06
2023/0210248 A1 * 7/2023 Joo ..... A46D 1/00 132/218
2023/0210249 A1 * 7/2023 Joo ..... A46D 1/00 132/218
2023/0292911 A1 * 9/2023 Castex ..... A46D 3/00 132/218
2024/0081517 A1 * 3/2024 Borsari ..... A46D 9/02

* cited by examiner

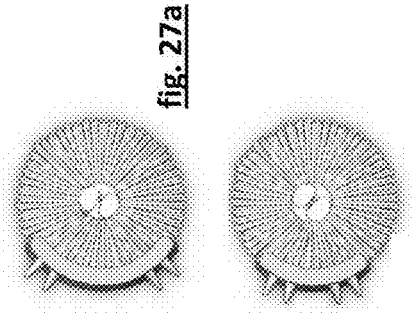
fig. 27a
Fig. 27b
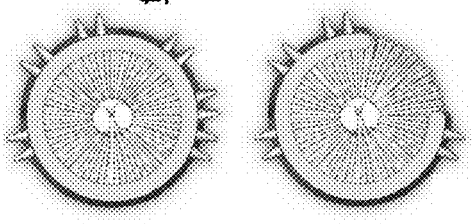
fig. 26a
Fig. 26b
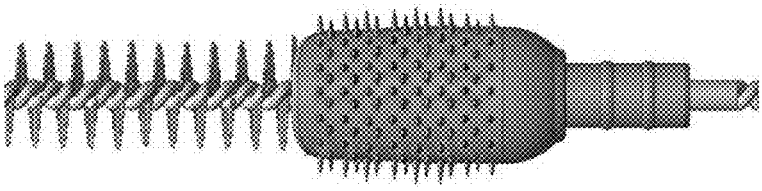
Fig. 25
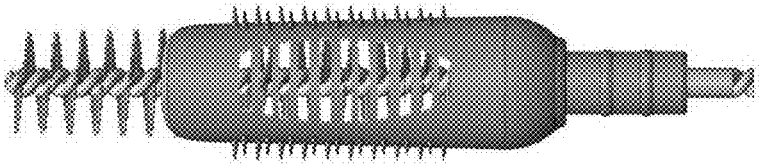
Fig. 24
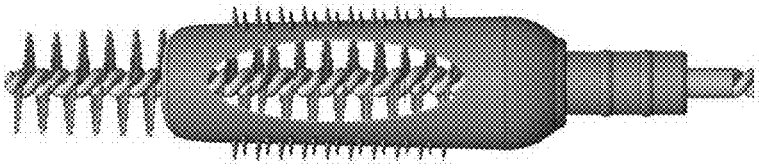
Fig. 23
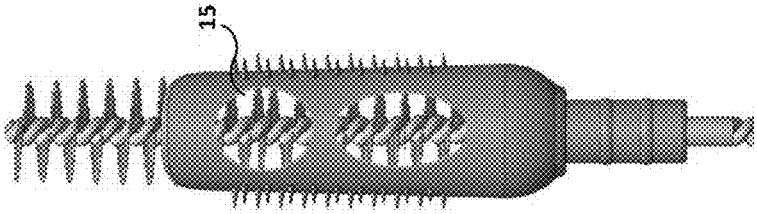
Fig. 22
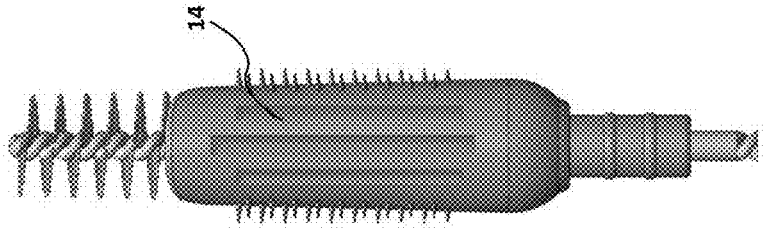
Fig. 21
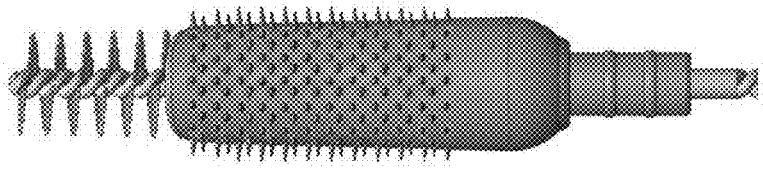
Fig. 20

APPLICATOR FOR COSMETICS IN TWO COMPONENTS

CROSS-REFERENCE TO RELATED APPLICATIONS

This application claims the benefit of Italian Patent Application no. 102021000002843, filed 9 Feb. 2021, the entire disclosure of which is hereby incorporated herein by reference.

FIELD OF THE INVENTION

This invention concerns an applicator for paste cosmetics; namely, an applicator for cosmetics made up of two different components.

BACKGROUND OF THE INVENTION

The applicator field contains a particularly large array of solutions, all aimed at making the practice of applying cosmetics more pleasant and efficient. Great efforts have been expended on the materials used, and on the shapes given to the application elements, in most cases, however, leading to two principal elements being defined: the bristle structure and the moulded product structure.

In several cases, a hybrid solution has been created, in which, specifically, a combined applicator consisting of a bristle structure and a moulded element is envisaged.

U.S. Pat. No. 6,408,857 envisages the association of a bristle brush and a plastic applicator, the association being guaranteed by inserting the plastic element into the central iron core, replacing part of the bristles with the plastic body.

EP 1475013 consists of a conventional brush which envisages the insertion of a rigid plastic element into the bristle brush, with the bristle part being milled, and the rigid applicator element having two attachment points at the ends of the brush body.

US20200383462: concerns an applicator for cosmetics that comprises a handle, and a stem which on one side is connected to the handle, and on the other side bears an applicator that comprises a brush which consists of a core and bristles that are held by the core in a portion which holds the bristles, the bristles having free ends that define an envelope surface and a comb containing several application elements held in a support, in which the support for the comb is integral with the stem.

WO2013/153525 describes an applicator provided with a stem and a twisted core, which houses a brush equipped with bristles and an applicator unit arranged between the bristles and the stem, which can rotate freely on the twisted core.

US2020/383462 describes an applicator for cosmetic products for eyelashes, which comprises a gripping element, a stem whose longitudinal axis bears a first extremity affixed to the gripping element, and a second opposing extremity, with an applicator element affixed to the second extremity of said stem which comprises a brush consisting of a core and bristles held by the core in a portion of the core that bears the bristles, the bristles having free ends that define an envelope surface, and a comb containing several application elements held in a support element, which is integral with the stem.

The solutions laid out above certainly possess useful characteristics for guaranteeing excellent results; however, they entail some problems that complicate the process, especially during the phase of combining the conventional body equipped with bristles with the rigid element, as it is necessary to carry out several processes on the conventional bristle body. These processes require spending a considerable amount of time to obtain the correct calibration, necessitating the identification of positions and angles, with a significant increase in costs.

BRIEF SUMMARY OF THE INVENTION

Hence, the purpose of this invention is to create an applicator with two components; that is, a bristle element and an element in a rigid material, which is easy to manufacture and to assemble.

Said purpose is achieved by means of an applicator for cosmetic products consisting principally of a wire made of metal material, which consists of a U-shaped body bearing tufts of bristles inside it that is subsequently subjected to multiple twists so as to form a single body capable of holding said tufts in a stable position and arranging them into a spiral pattern, wherein an element in plastic material positioned outside said wire of metal material is associated with said brush, and held in stable engagement with it, said element being composed of a centrally pierced cylindrical base body flanged at one extremity, with a shaped wall departing vertically from the external edge of said flange, only partially covering said brush, said shaped wall bearing on its external surface at least one series of cosmetic product applicator tips, said hole of said base of said plastic element housing the terminal portion of said brush.

In addition, the cylindrical base body has toroidal ribs along its external surface designed to engage the brush thus constituted with the stem of the gripping and manoeuvring element of the applicator.

BRIEF DESCRIPTION OF THE DRAWINGS

Here below is a description of the applicator according to the invention, making reference to one particular embodiment of it, as depicted in the diagrams, in which:

FIG. 3 is the side view, of which

FIG. 11*a* is the side view of a second embodiment of the invention, of which

FIG. 14 is the front view of a first form of scraper according to a first embodiment of the invention, of which

FIG. 16 is the front view of a second form of scraper according to a first embodiment of the invention, of which

FIG. 18 is the front view of a second form of scraper according to a first embodiment of the invention, of which

FIGS. 20 to 25 are views of particular embodiments of the applicator, showing various types of plastic elements according to a first embodiment of the invention;

FIGS. 26*a* and 26*b*, and FIGS. 27*a* and 27*b* are views from above of further specific embodiments of the applicator.

DESCRIPTION OF THE PREFERRED EMBODIMENTS

Figure 4:
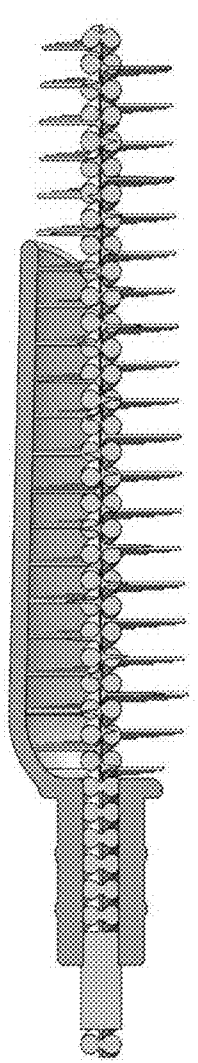
FIG. 4 is the sectional view
Figure 3:
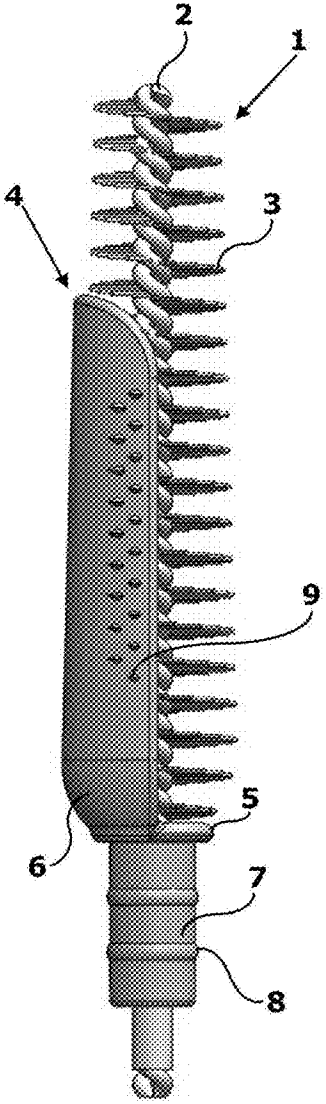
Figure 2:
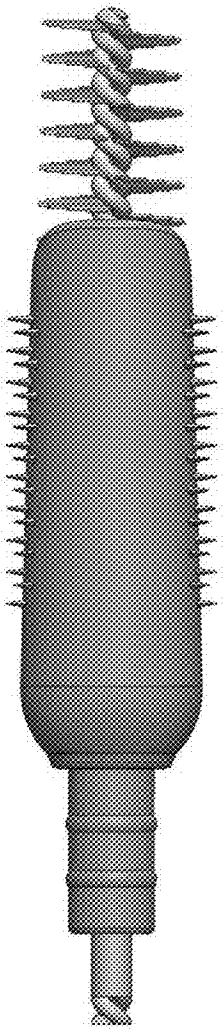
FIG. 2 is the rear view.
Figure 1:
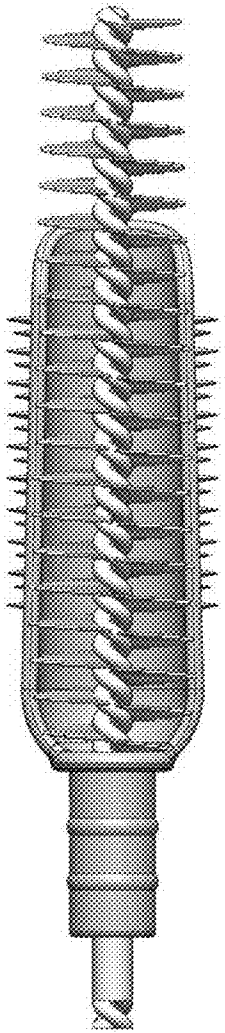
FIG. 1 is the front view of a first embodiment of the invention.

According to the first embodiment of the invention, the applicator is constituted by a brush 1 composed of a metal wire 2, arranged in a U shape, with bristle tufts 3 of equal length and held equidistant to each other arranged inside said metal wire 2, said brush 1 having undergone multiple twists to constitute a single body capable of supporting said bristle tufts 3 in a stable position, and arranging them in accordance with a spiral pattern.

Associated with said brush 1 is a plastic element 4 composed of a centrally pierced cylindrical base body 7, which is provided with a flange 5 at one extremity. A shaped wall 6 departs from a portion of the perimeter surface of the flange 5, said shaped wall 6 describing an arc of circumference, in such a way that the brush 1 is only partially covered. In some possible embodiments, the shaped wall 6 extends vertically for a height not greater than the height of said brush 1, while in other embodiments, the shaped wall 6 exceeds said brush 1 in height.

The cylindrical base body 7 has sufficient length for the brush 1 to be housed in the pierced portion thereof, holding it in the correct position, if necessary with the brush 1 being able to protrude outside said cylindrical base body 7, as illustrated, by way of example and not limited to, in FIG. 4. In other words, the pierced portion of the cylindrical base body 7 of said plastic element 4 houses the terminal portion of said brush 1 inside it, thus allowing a stable fit and guaranteeing correct alignment.

At the same time, on the external surface of said cylindrical base body 7, there are toroidal ribs 8 for engagement by interference with the internal surface of a cavity built into the distal extremity of the stem S associated with the handle I of the applicator assembly.

At the lateral ends of its external surface, the shaped wall 6 has two series of tips 9 for applying a cosmetic product, each series being constituted by two rows of tips 9, arranged in a staggered pattern.

Figure 5:
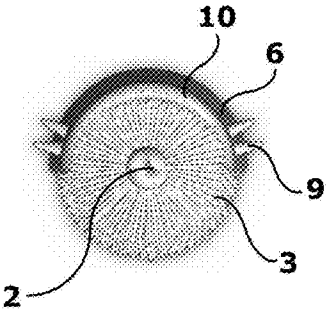
FIG. 5 is the view from above.
Figure 6:
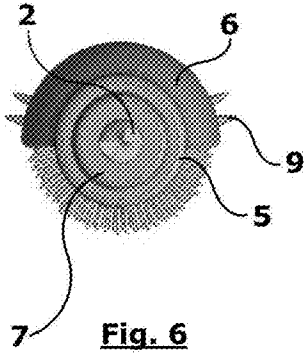
FIG. 6 is the view from below.
Figure 14:
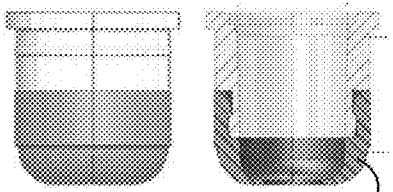
Figure 15:
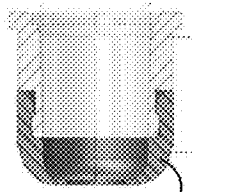
FIG. 15 is the sectional view.
Figure 17:
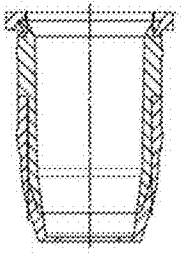
FIG. 17 is the sectional view.
Figure 16:
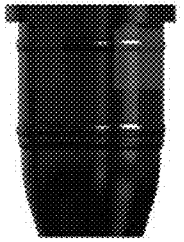
Figure 19:
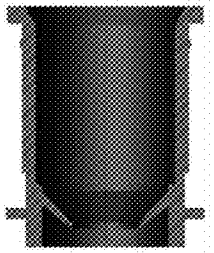
FIG. 19 is the sectional view.
Figure 18:
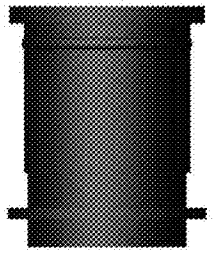
Figure 8:
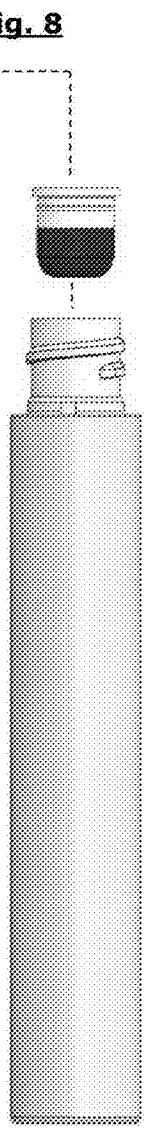
FIG. 8 is a view of the applicator assembly, ready for marketing.
Figure 7:
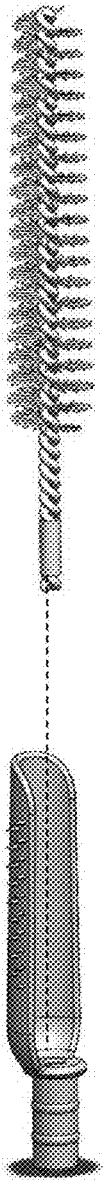
FIG. 7 is the exploded view.
Figure 11B:
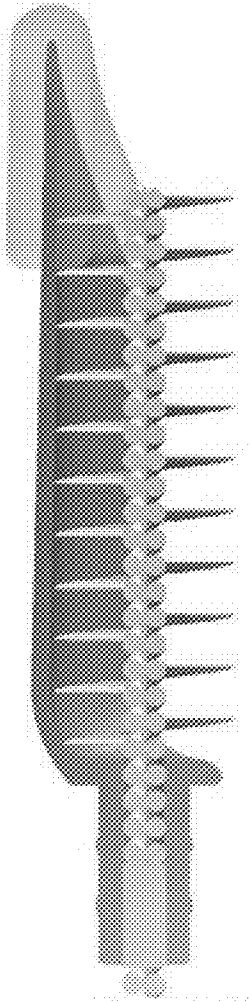
FIG. 11*b* is the partially sectional view.
Figure 11A:
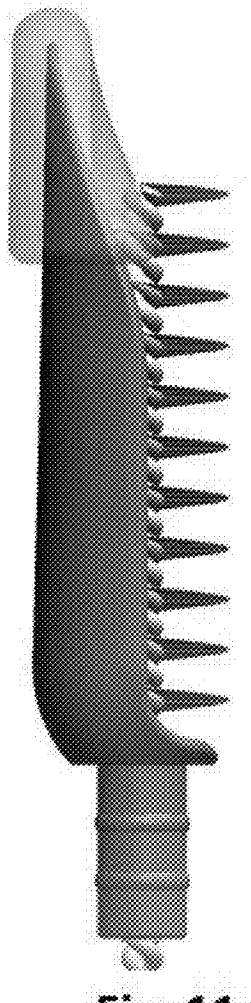
Figure 10:
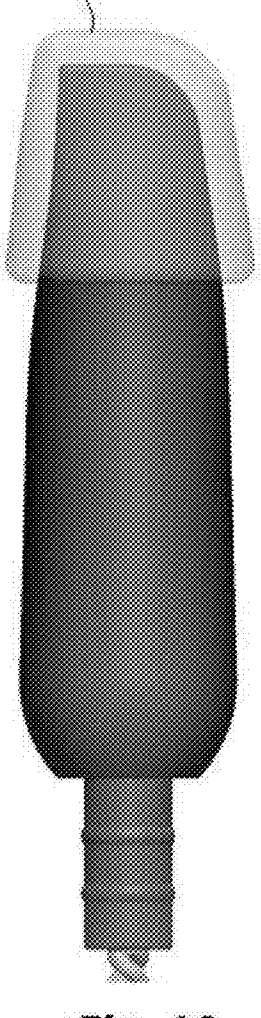
FIG. 10 is the rear view of a second embodiment of the invention.
Figure 9:
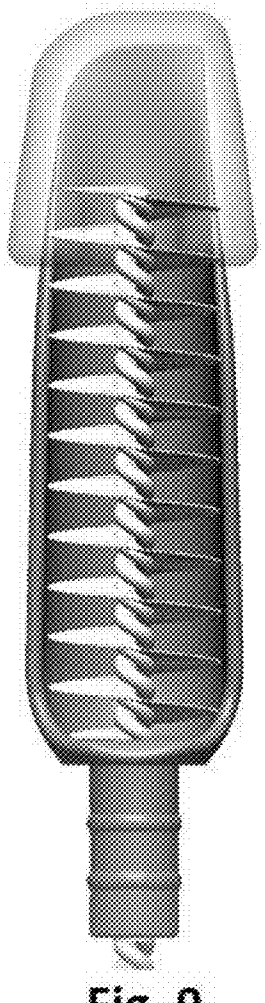
FIG. 9 is the front view of a second embodiment of the invention.
Figure 12:
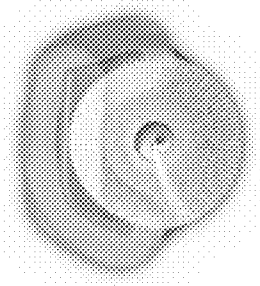
FIG. 12 is the view from above of a second embodiment of the invention.
Figure 13:
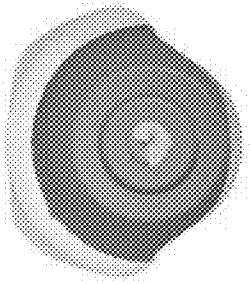
FIG. 13 is the view from below of a second embodiment of the invention.

The plastic element 4 is shaped in such a way that it touches the bristle tufts 3 that constitute the brush 1, at the same time having wide free spaces, with the bristle tufts 3 spaced apart from each other. As can best be seen from FIGS. 4 and 5, the structure thus constituted identifies a reservoir area for the cosmetic material between one bristle tuft and another, exploiting the interspace 10 that is created between the internal surface of the plastic element 4 and the bristle tufts 3, and using the plastic element 4 itself in conjunction with it as a container, although it is open on the sides. In correspondence with the point of contact between the flanged surface of the cylindrical base element 5 and the shaped wall 6, there is a basin in the internal surface of the plastic element 4 for housing the cosmetic product which extends vertically—following the course of the shaped wall 6—into the interspace 10.

An improved solution of the first embodiment can be seen from FIGS. 9 to 13: it, too, consists of a brush 1 associated with a shaped plastic element 4, and it also bears a flocked appendix 12 on the summit of the shaped wall 6, which is aimed at perfecting the properties of the applicator, allowing the user to avail of a finishing element of the substance applied, which is similar in function and effect to a brush, or pencil, depending on its structure and the profile of the summit of said shaped wall 6.

The figures illustrate a flocked appendix 12 which has a hood-shaped structure, but it has a merely illustrative function. This flocked appendix 12 can be made in any shape, in accordance with manufacturing, aesthetic, or functional purposes.

As illustrated in FIGS. 14 to 19, the scrapers for the applicator of this invention can have the most wide-ranging shapes, albeit in accordance with per se known characteristics, provided that they are at least in part composed of flexible or deformable material.

In fact, it is possible to envisage a scraper consisting of two components (FIG. 14 and FIG. 15), in accordance with techniques per se known, in which the scraper element portion 13 is made of flexible or deformable material.

In the solutions illustrated in FIGS. 16 to 19, on the other hand, a scraper made of a single piece is envisaged, having different geometries in the scraping area. In this case, the entire scraper is entirely composed of flexible or deformable material.

As it could be understood, it is possible to implement various measures on the external wall of the plastic element 4, which are aimed at making the applicator consistent with the user's needs.

Preferably, as is illustrated in FIG. 20, it is possible for the external wall of the plastic element 4 to be entirely covered by a sequence of series of tips 9, which are arranged parallel and equidistant to each other.

Furthermore, as in FIG. 21, it is possible to provide at least one groove 14, envisaged in the area between the—at least two—series of tips 9, for collecting the material to subsequently allow it to be deposited, when the applicator is in place. These grooves can have any shape or arrangement, for example, approximating a message, whether it be in symbols or letters.

It is also possible to provide perforated solutions, as illustrated in FIGS. 22 to 24, in which one or more holes are envisaged, which allow a further deposit, in accordance with the user's requirements, of the cosmetic collected inside the container, as well as greater action of the bristle tufts 3, even in the fraction theoretically dedicated to the plastic element 4.

Moreover, as is proposed in FIG. 25, it is possible to provide a plastic element 4 that covers the brush only minimally, for example halfway, if required providing for the decorative and functional measures described for the previous embodiments.

In the embodiments heretofore described, the plastic element 4 has an arc of 180°, to ensure the substantial aesthetic and functional balance between the plastic element 4 and the bristle tufts 3.

Lastly, it should be noted that up to now, we have considered a plastic element 4 having an arc with a circumference of about 180°. However, as illustrated in FIGS. 26*a* and 26*b*, and FIGS. 27*a* and 27*b*, there is nothing to prevent the arc from being less than or greater than 180°, for example, an arc between 45° and 315°: in fact, there is no discernible substantial structural or functional difference.

It seems clear that the principal purpose of the invention has thus been achieved; that is, an applicator for cosmetics that is light and easy to set up during the assembly phase. At the same time, various measures have been implemented that allow the user to reduce the number of times the container is accessed in order to have the applicator sufficiently loaded with product for the make-up to be correctly applied.

It is understood that the solutions described above are only some of the possible embodiments of this invention, and that there may be several variants that do not differ from the scope of protection defined by the attached claims.

The invention claimed is:

1. An applicator for cosmetic products comprising:

a brush comprising a metal wire arranged in a U-shape with bristle tufts inside the metal wire, wherein the metal wire is subjected to multiple twists so as to form a single body holding said bristle tufts in a stable position and arranging the bristle tufts into a spiral pattern, and a plastic element arranged outside said metal wire and associated with said brush, said plastic element comprising:

a cylindrical base body provided with a flange at one extremity, and a shaped wall departing vertically from an external edge of said flange, only partially covering said brush, said shaped wall having an external surface bearing at least one series of cosmetic product applicator tips, wherein a pierced portion of said cylindrical base body houses a terminal portion of said brush, wherein the plastic element and brush extend longitudinally in a vertical direction, and a first vertical distance between a distal end of the plastic element and the flange is less than a second vertical distance between a distal end of the brush and the flange, such that the plastic element does not cover the distal end of the brush, and wherein said at least one series of cosmetic product applicator tips includes at least two contiguous rows of cosmetic product applicator tips, arranged in a staggered pattern from each other.

2. The applicator of claim 1, wherein a flocked appendix is provided on an upper surface of the shaped wall for absorption of a cosmetic substance and for tracing lines.

3. The applicator of claim 1, wherein said at least one series of cosmetic product applicator tips are provided on lateral ends of the external surface of the shaped wall.

4. The applicator of claim 1, wherein an external surface of said cylindrical base body has toroidal ribs for engagement by interference with an internal surface of a cavity in a distal extremity of a stem.

5. The applicator of claim 1, wherein said plastic element is internally shaped so as to define a basin in the vicinity of a point of contact between an upper surface of said flange and said shaped wall.

6. The applicator of claim 1, wherein said plastic element includes an arc between 45° and 315°.

7. The applicator of claim 1, wherein said plastic element includes an arc between 160° and 180°.

8. The applicator of claim 1, wherein:

said at least one series of cosmetic product applicator tips includes rows of cosmetic product applicator tips, and the external surface of said shaped wall is entirely covered by said rows of cosmetic product applicator tips.

9. The applicator of claim 1, wherein:

said at least one series of cosmetic product applicator tips includes rows of cosmetic product applicator tips, and the external surface of said shaped wall has at least one groove for depositing cosmetic material in an area between said rows of cosmetic product applicator tips.

10. The applicator of claim 1, wherein:

said at least one series of cosmetic product applicator tips includes rows of cosmetic product applicator tips, and the external surface of said shaped wall has at least one hole in an area between said rows of cosmetic applicator tips.

11. An applicator system comprising:

the applicator of claim 1, and a scraper for the applicator.

12. The applicator system according to claim 11, wherein the scraper is a single piece and comprises a flexible or deformable material.

13. The applicator system according to claim 11, wherein the scraper comprises multiple and separate components, and a portion of the scraper comprises a flexible or deformable material.

14. The applicator system according to claim 11, further comprising a handle, a stem, and a container.

15. The applicator of claim 1, wherein said plastic element is shaped in such a way that the plastic element touches the bristle tufts of said brush.

* * * * *